US005136133A

United States Patent [19]

Briggs et al.

[11] Patent Number: 5,136,133

[45] Date of Patent: Aug. 4, 1992

[54] MICROWAVE HEATING APPARATUS

[76] Inventors: David H. Briggs, Manor House Farm, Silchester, NR Reading RG7 2HL; Richard F. Freeman, 13 High St., Linton, Cambridge CB1 6HS, both of Great Britain

[21] Appl. No.: 671,829

[22] PCT Filed: Sep. 28, 1989

[86] PCT No.: PCT/GB89/01150

§ 371 Date: May 22, 1991

§ 102(e) Date: May 22, 1991

[87] PCT Pub. No.: WO90/03716

PCT Pub. Date: Apr. 5, 1990

[30] Foreign Application Priority Data

Sep. 28, 1988 [GB] United Kingdom ..... 8822705

[51] Int. Cl.[5] ..... H05R 6/72

[52] U.S. Cl. ..... 219/10.55 F; 219/10.55 E; 219/10.55 D

[58] Field of Search ..... 219/10.55 F, 10.55 A, 219/10.55 E, 10.55 R, 10.55 D

[56] References Cited

U.S. PATENT DOCUMENTS

| | | | |
|---|---|---|---|
| 2,956,144 | 10/1960 | Woodman | 219/10.55 R |
| 3,701,872 | 10/1972 | Levinson | 219/10.55 E |
| 3,731,037 | 5/1973 | Levinson | 219/10.55 E |
| 3,783,220 | 1/1974 | Tanizaki | 219/10.55 E |
| 3,934,106 | 1/1976 | MacMaster | 219/10.55 E |
| 4,803,324 | 2/1989 | Fujii et al. | 219/10.55 F |

FOREIGN PATENT DOCUMENTS

| | | |
|---|---|---|
| 1049019 | 1/1959 | Fed. Rep. of Germany . |
| 1161350 | 8/1969 | United Kingdom . |

*Primary Examiner*—Philip H. Leung

*Attorney, Agent, or Firm*—Lee, Mann, Smith, McWilliams, Sweeney & Ohlson

[57] ABSTRACT

A microwave-powered heating chamber has a ceramic support (12) for foodstuff (10), and a curved surface (20) of microwave absorbing material disposed opposite a waveguide (16) which is connected to a microwave energy source, such as a magnetron (14). A reflecting shield may be temporarily positioned over the curved surface (20) to enable the foodstuff to be microwave-heated, after which the shield is removable to allow browning to occur.

5 Claims, 1 Drawing Sheet

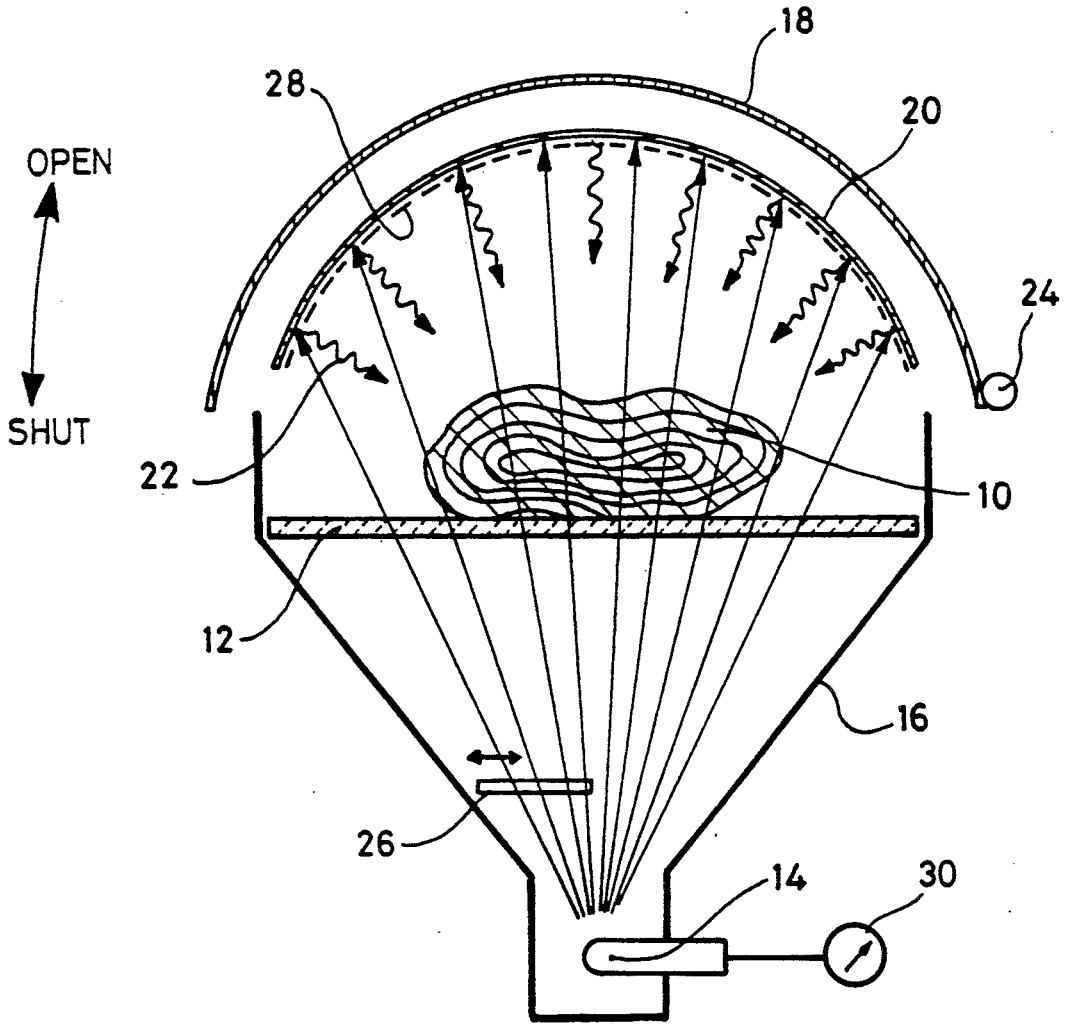
18
28
20
OPEN
SHUT
24
22
10
12
16
26
14
30

MICROWAVE HEATING APPARATUS

FIELD OF THE INVENTION

This invention concerns chambers for heating foodstuffs, particularly frozen pre-cooked food, using microwave energy.

BACKGROUND TO THE INVENTION

There is an increasing demand for fast food typically at railway stations, airports and garages. One of the more convenient ways of storing such pre-cooked foodstuffs is by deep freezing them after cooking and it is then only necessary to re-heat the foodstuff as quickly as possible to provide a hot meal or snack.

Microwave energy is most conveniently used for such reheating, and it is an object of the present invention to provide an improved form of heating chamber particularly adapted to the re-heating of pre-cooked foodstuffs which require to be browned during the heating process.

SUMMARY OF THE INVENTION

According to the present invention a chamber for heating foodstuffs which includes a source of microwave energy for projecting microwave energy into the chamber, a curved microwave absorbing surface is located opposite the waveguide to convert microwave energy incident thereon into infra-red radiation, and to direct or focus the infra-red radiation generally towards the centre of the chamber wherein is located a support by means of which the foodstuff can be located at or near the focal point of the curved surface.

Where the foodstuff and platform are to be located between the open end of the waveguide and the reflecting surface, the foodstuff support is preferably formed from material which is substantially transparent to microwave radiation so that the latter can pass through the support.

Where the support is an absorber of infra-red radiation, the support will be heated and assist in browning the underside of the foodstuff.

The foodstuff will be, to a greater or lesser extent, also transparent to microwave energy and consequently radiation emanating from the source in alignment with the foodstuff will partially heat the foodstuff and partially pass therethrough to be absorbed by the absorbing surface and once again intercept the foodstuff - this time as infra-red radiation.

In conventional manner, means may be provided to time the period during which microwave energy is supplied to the chamber.

Means may be provided within the source of microwave energy to alter the direction in which the radiation enters the chamber or to alter the virtual point from which the radiation appears to come, so as to alter the position of the point in the chamber at which the radiation is generally brought to a focus or concentration. In one aspect, this is achieved by moving an inserted element in the wave guide, so the position of focus can be varied to produce more uniform heating of the foodstuff.

In another embodiment, moving or fixed elements, as appropriate may be used to match more closely the concentration of the E-field to each of several different food products.

Where a microwave-absorbing browning aid is located within the chamber in accordance with the invention, a removable shield of microwave reflecting material may be located over the surface of the absorbing material until such time as the microwave heating has raised the temperature of the foodstuff sufficiently, after which the shield is removed, to allow browning to occur.

BRIEF DESCRIPTION OF THE DRAWING

The invention will now be described by way of example with reference to the accompanying drawing in which the single Figure is a schematic cross-section through a food heating chamber constructed as one embodiment of the invention.

DETAILED DESCRIPTION OF THE PREFERRED EMBODIMENT

The drawing shows a microwave heating chamber for heating pre-cooked foodstuffs, of which an example is shown at 10. The latter is carried by a support plate of ceramic material 12 so as to be transparent to the microwave energy which emanates from a magnetron 14 which is located at the lower end of a wave guide 16 the upper end of which includes the circular plate 12 on which the foodstuff is located.

Above the plate 12 is located a hemispherical domed or similarly shaped closure member or lid 18 which carries a similarly shaped microwave absorbing member 20, which on being heated by incident microwave energy emits infra-red radiation as at 22 in a direction towards the foodstuff 10.

The distance of the member 20 from the foodstuff and the radius of the hemispherical surface of the member 20 is selected so that in general any infra-red radiation emanating therefrom will be focussed towards the central region of the plate 12, and thereby towards the foodstuff 10 located thereon. Inserted in the waveguide 16 is a stirrer element 26 which is moveable in the waveguide so that the focussing point can be varied to produce more uniform heating of the foodstuff.

The hemispherical dome 18 forms a lid to the chamber, to which end the dome is hinged as at 24 so as to be capable of being lifted to reveal the interior of the chamber to allow foodstuff to be inserted or removed.

The member 20 may be removable so as to be capable of being inserted after a preliminary heating process.

In accordance with the invention, however, a removable shield 28 of microwave-reflecting material is located in front of the member 20 until browning is required. To this end, the period during which microwave energy is supplied to the chamber 10 is controlled by a timer 30.

We claim:

1. A microwave heating apparatus for heating foodstuff comprising:

a) a heating chamber;

b) a foodstuff support mounted generally towards the centre of the chamber and on which foodstuff is locatable;

c) a source of microwave energy for projecting microwave energy into the chamber via a waveguide connected to the chamber;

d) a curved surface of microwave-absorbing material located in the chamber opposite the waveguide to convert microwave energy incident thereon into infra-red radiation for browning said foodstuff, and to focus said infra-red radiation generally towards said centre of the chamber, whereby the foodstuff is locatable in the vicinity of the focal point of the curved surface; and e) a removable shield of microwave-reflecting material locatable in front of said curved surface, whereby when the microwave heating has raised the temperature of the foodstuff to a desired level, said shield is then removable to allow browning to occur.

2. A chamber according to claim 1 in which said waveguide has an open end and said foodstuff support is located between said open end and said curved surface, said support being formed from material which is substantially transparent to microwave radiation, so that the latter can pass through the support.

3. A chamber according to claim 1 further comprising means to time the period during which microwave energy is supplied to the chamber.

4. A chamber according to claim 1 in which stirrer means is provided within the source of microwave energy to alter the direction in which the radiation enters the chamber or to alter the virtual point from which the radiation appears to come, so as to alter the position of said focal point in the chamber at which the radiation is generally brought to a focus.

5. A chamber according to claim 4 in which said stirrer means comprises an element inserted in the waveguide, so that said focal point can be varied to produce more uniform heating of the foodstuff.

* * * * *